US005321487A

United States Patent [19]

Shiba et al.

[11] Patent Number: 5,321,487

[45] Date of Patent: Jun. 14, 1994

[54] COLOR CORRECTION STRUCTURE FOR COLOR IMAGING DEVICE

[75] Inventors: Sukenori Shiba, Naritanishi; Minoru Suzuki, Omiya, both of Japan

[73] Assignee: Asahi Kogaku Kogyo Kabushiki Kaisha, Tokyo, Japan

[21] Appl. No.: 945,601

[22] Filed: Sep. 16, 1992

[30] Foreign Application Priority Data

Sep. 17, 1991 [JP] Japan ..... 3-311271

[51] Int. Cl.[5] ..... G03G 13/01

[52] U.S. Cl. ..... 355/327; 355/35; 355/71; 359/889

[58] Field of Search ..... 355/326, 327, 32, 35, 355/38, 71; 359/889, 890

[56] References Cited

U.S. PATENT DOCUMENTS

| | | | |
|---|---|---|---|
| 4,095,879 | 6/1978 | Katayama et al. | 355/326 |
| 4,557,585 | 12/1985 | Abuyama | 355/233 |
| 4,825,252 | 4/1989 | Suzuki et al. | 355/32 |
| 4,860,059 | 8/1989 | Terashita | 355/38 |
| 4,912,503 | 3/1990 | Sawaki et al. | 355/35 |
| 4,924,255 | 5/1990 | Horaguchi et al. | 355/32 X |
| 4,939,537 | 7/1990 | Masuda et al. | 355/35 |
| 4,964,696 | 10/1990 | Suzuki et al. | 359/889 |
| 4,965,625 | 10/1990 | Sakakibara et al. | 355/35 |
| 4,974,937 | 12/1990 | Haigo et al. | 355/35 X |
| 5,033,820 | 7/1991 | Hama | 359/889 |
| 5,033,821 | 7/1991 | Hama et al. | 359/889 |
| 5,117,253 | 5/1992 | Suzuki | 355/32 |

FOREIGN PATENT DOCUMENTS

| | | |
|---|---|---|
| 0005767 | 1/1987 | Japan . |
| 62-246036 | 10/1987 | Japan . |
| 0259632 | 10/1988 | Japan . |

*Primary Examiner*—A. T. Grimley
*Assistant Examiner*—Robert Beatty
*Attorney, Agent, or Firm*—Sandler Greenblum & Bernstein

[57] ABSTRACT

A color correction structure for a color imaging device in which a document is scanned in a predetermined direction by a slit exposure light. A light reflected on the document is lead to a photoconductive member along an optical path, and an image of the document is focused on the photoconductive member by a focusing lens which is arranged in the optical path. The color correction structure is provided with a plurality of filter members each transmitting reflected light having a predetermined wavelength, and at least one actuator for actuating the filter members in a direction substantially perpendicular to an extending direction of the slit exposure light, between a first position where the filter members are retracted from the light path and a second position where the filter members interferes with the light path. A controller controls the actuator for brightness and hue adjustments.

26 Claims, 6 Drawing Sheets

COLOR CORRECTION STRUCTURE FOR COLOR IMAGING DEVICE

BACKGROUND OF THE INVENTION

The present invention relates to a color correction structure for a color imaging device for correcting color using a plurality of filters.

A color imaging device, such as, for example, a color copy machine and the like, is arranged such that the imaging light of a color document is projected to a color photoconductive material; the color photoconductive material is exposed by the image light of the document; and thereafter, the color photoconductive material is subjected to development and fixing processes to provide a copy of color. The exposure of the color photoconductive material is carried out by focusing the image of the color document on the surface of a photoconductive agent of the color photoconductive material by an optical system having a focusing lens.

This type of color imaging device is provided with a color correction structure so that the spectral distribution of an image light can be adjusted in correspondence with the spectral sensitivity characteristics of (i.e., the property of sensitivity which is different depending upon a wavelength) of a photoconductive material, so that the tone of a document can be corrected or the color of the document can be changed to an arbitrary color. Further, an amount of light adjustment structure is also needed.

The amount of light adjustment structure is, usually composed of a variable diaphragm that is disposed in a focusing lens.

The color correction structure is composed of a plurality of filters. These filters absorb 100% of a monochromatic light of a specific color, and are disposed midway in the light path of an image light, so that the amount of interference of the filters with the light path can be independently adjusted. These filters are usually composed of three kinds of filters, a yellow filter for absorbing a blue light, a magenta filter for absorbing a green light and a cyan filter for absorbing a red light, and they are used in combination.

The aforesaid color correction stucture is preferably incorporated in the focusing lens from the view point of the space efficiency of the imaging device as a whole.

Nevertheless, in this arrangement, both color correction structure and amount of light adjustment structure are incorporated in the focusing lens, and as a result, the focusing lens is increased in size thereby to increase the size of the imaging device as a whole. Further, the color correction structure and amount of light adjustment structure are made complex because a driving mechanism must be provided with each structure.

To cope with this problem, there is an arrangement for reducing the size of the interior of a focusing lens incorporating filters. According to this conventional arrangement, two slender filter plates, each having a filter region for absorbing a monochromatic light of different color, are disposed on opposite sides of a transparent transmitting filter region. The two filter plates are independently moved in a longitudinal direction thereof and disposed in a direction perpendicular to the light axis of the focusing lens so that the respective filter regions can interfere with the light path in the focusing lens.

For example, a first filter plate, including a yellow (hereinafter, abbreviated as Y) filter and magenta (hereinafter, abbreviated as M) filter disposed on the opposite sides of a transmitting region, and a second filter plate including a cyan (hereinafter, abbreviated as C) filter and yellow (Y) filter disposed on the opposite sides of the transmitting region are positioned in the focusing lens so that they can be independently moved in the longitudinal direction thereof. With this arrangement, the Y, M or C filter can be independently caused to interfere with the light path in such a manner that the transmitting region of one of the filter plates is located in the light path and the other filter plate is moved to cause an arbitrary filter to interfere with the light path. Further, the Y and M filters, the M and C filters, or the C and Y filters can be caused to interfere with the light path in combination by relatively moving both filter plates.

With this arrangement, the size of the filter portion can be reduced because the three filters can be replaced with the two filter plates.

Nevertheless, the two filter plates must be spaced apart from each other in the optical axial direction of the focusing lens because the two filter plates are moved relatively to each other. In this arrangement, a problem of the occurrence of an irregular color arises because these two filter plates interfere with the light path at different positions in the optical axis direction.

More specifically, when filters of the two filter plates correct color in combination, the two filters are dislocated in the optical axial direction. As a result, when lights are supplied from different points on the document in the width direction thereof which is parallel with the direction in which the filter plates are moved (the direction along which the filters enter a light path and exits therefrom), the ratios of the areas of the light paths formed by these lights and occupied by these two filters, respectively, to the entire areas thereof (amounts of interference of the filters with the light paths) are different, to thereby cause the irregular color.

This will be described more specifically with reference to the schematic diagram of FIG. 1, showing two different points A and B located in the width direction of the document 80. The filter 91A of a first filter plate 91 has an amount of interference with the light path formed by the image light from point A: LA1 and an amount of interference with the light path formed by the image light of the point B: LB1 which is different from LA1 (LA1≠LB1). In the same way, filter 92A of a second filter plate 92 has an amount of interference with the light path formed by the image light from the point A: LA2 and an amount of interference with the light path formed by the image light of the point B: LB2 which is different from LA2. As a result, the amount of color correction at point A is different from that at point B.

Further, since the filters are located in the focusing lens, when they are not flat and not parallel with each other, the optical performance of the focusing lens is greatly degraded by the optical action of the filters. Consequently, a problem arises in that the filters must be formed with a pinpoint accuracy, and thus become expensive.

SUMMARY OF THE INVENTION

It is therefore a main object of the present invention to provide an improved color correction structure for a color imaging device by which a variable diaphragm for adjusting an amount of light can be omitted but which can adjust the amount of light, and the size and cost of a focusing lens can be reduced.

A secondary object of the present invention is to provide a color imaging device by which the size of a focusing lens is not increased, and thus the size of the imaging device as a whole can be reduced.

Further, a third object of the present invention is to provide a color correction structure for a color imaging device by which irregular color is not caused.

Furthermore, a fourth object of the present invention is to provide a color correction structure for a color imaging device, by which the optical performance of a focusing lens is not influenced by the accuracy of filters and the cost of the filters can be reduced by reducing the accuracy of the filters.

For the above objects, according to one aspect of the present invention, there is provided a color correction structure for a color imaging device in which a document is scanned in a predetermined direction by a slit exposure light, a light reflected on the document is lead to a photoconductive member along an optical path, and an image of the document is focused on the photoconductive member by a focusing lens which is arranged in the optical path, comprising filter means, for transmitting the reflected light having a predetermined wavelength, arranged in the optical path without the focusing lens; and actuating means for actuating the filter means in a direction substantially perpendicular to an extending direction of the slit exposure light, between a first position where the filter means is retracted from the light path and a second position where the filter means interferes with the light path.

Further, according to the other aspect of the present invention, the filter means includes a plurality of filter members, each having different wavelength transmitting characteristics, and the actuating means actuates each of the filters independently between the first position and the second position.

With this arrangement, the size of the focusing lens can be reduced because filters are not disposed in the focusing lens. Further, since the optical performance of the focusing lens is less influenced by the accuracy of the filters, the accuracy of the filters can be reduced. As a result, the filters may be formed of plastics to reduce the cost thereof.

Further, an amount of light can be adjusted in such a manner that the plurality of filter members are combined to substantially equally damp an amount of light over substantially the entire region of wavelengths being used and the combined filter members interfere with the light path by a suitable amount. Therefore, a variable diaphragm is not needed. Thus, the size and cost of the focusing lens can be reduced.

The above, and other objects, features and advantages of the present invention will become apparent from the following detailed description which is to be read in conjunction with the accompanying drawings.

DESCRIPTION OF THE ACCOMPANYING DRAWINGS

DESCRIPTION OF THE EMBODIMENTS

One embodiment of the present invention will be described below with reference to the drawings.

Figure 2:
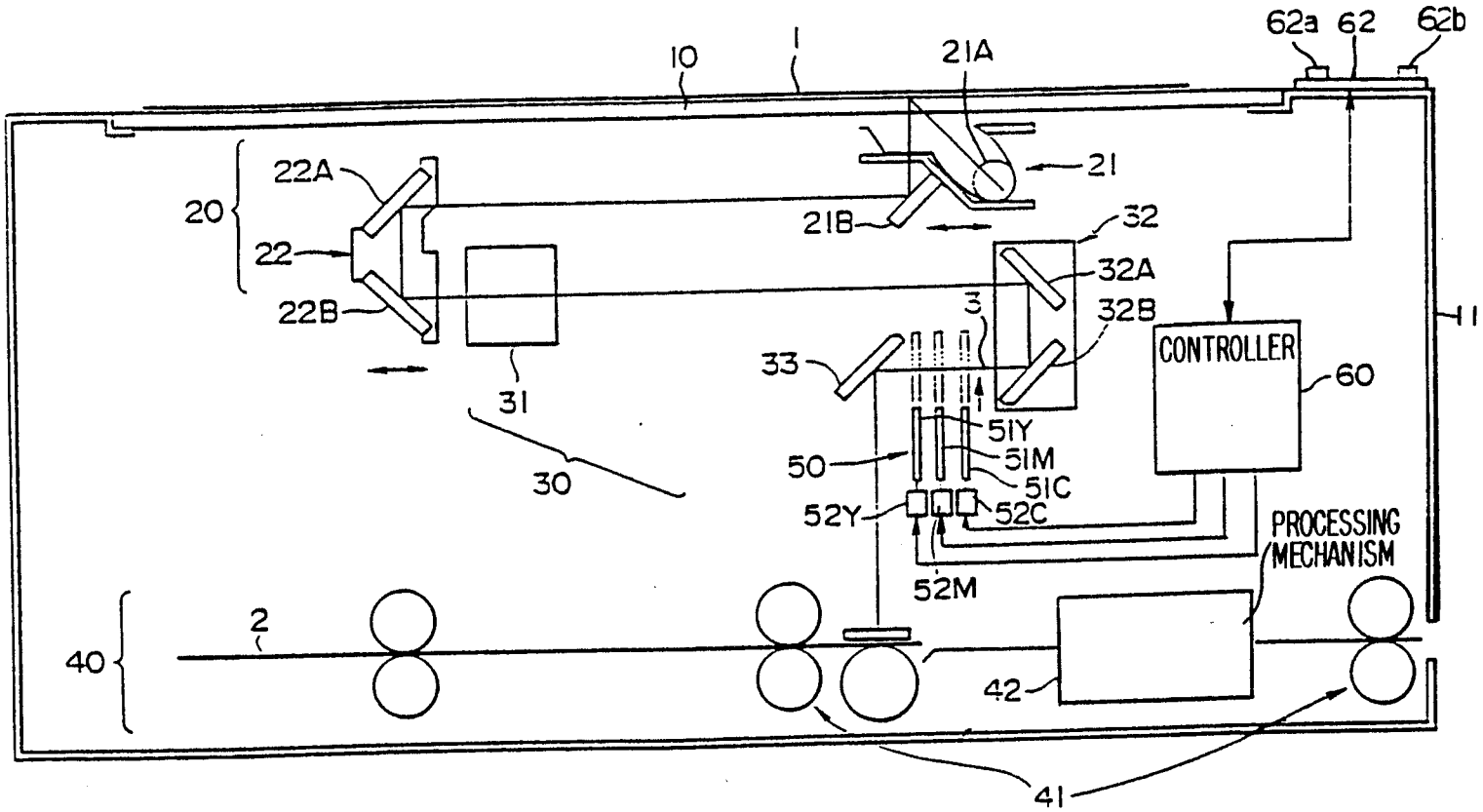
FIG. 2 is a side view showing a schematic arrangement of a slit scanning type color copy machine to which an embodiment of a color correction structure for a color imaging device according to the present invention is applied.

A color copy machine, as shown in FIG. 2, is a so-called slit exposure type copy machine for copying a document by scanning the document in a lengthwise direction thereof so that the document is scanned over the entire width thereof and in a very narrow region in the longitudinal direction thereof. The color copy machine includes a document table 10 composed of a transparent glass plate disposed on the upper surface of a main body 11. A scanning mechanism 20, focusing optical system 30, and an exposure/processing mechanism 40 including a feed mechanism 41 for feeding a photoconductive material are disposed below the document table 10 (on the inner side of the copy machine).

The scanning mechanism 20 has the same arrangement as that of a conventionally known slit exposure copy machine and includes a full-speed unit 21 and half-speed unit 22. The full-speed unit 21 is moved in parallel with the document table 10 at a predetermined speed. The half-speed unit 22 is moved at a speed one half the speed of the full-speed unit 21 in synchronism the movement of the full-speed unit 21 in the same direction as the full-speed unit 21.

Figure 1:
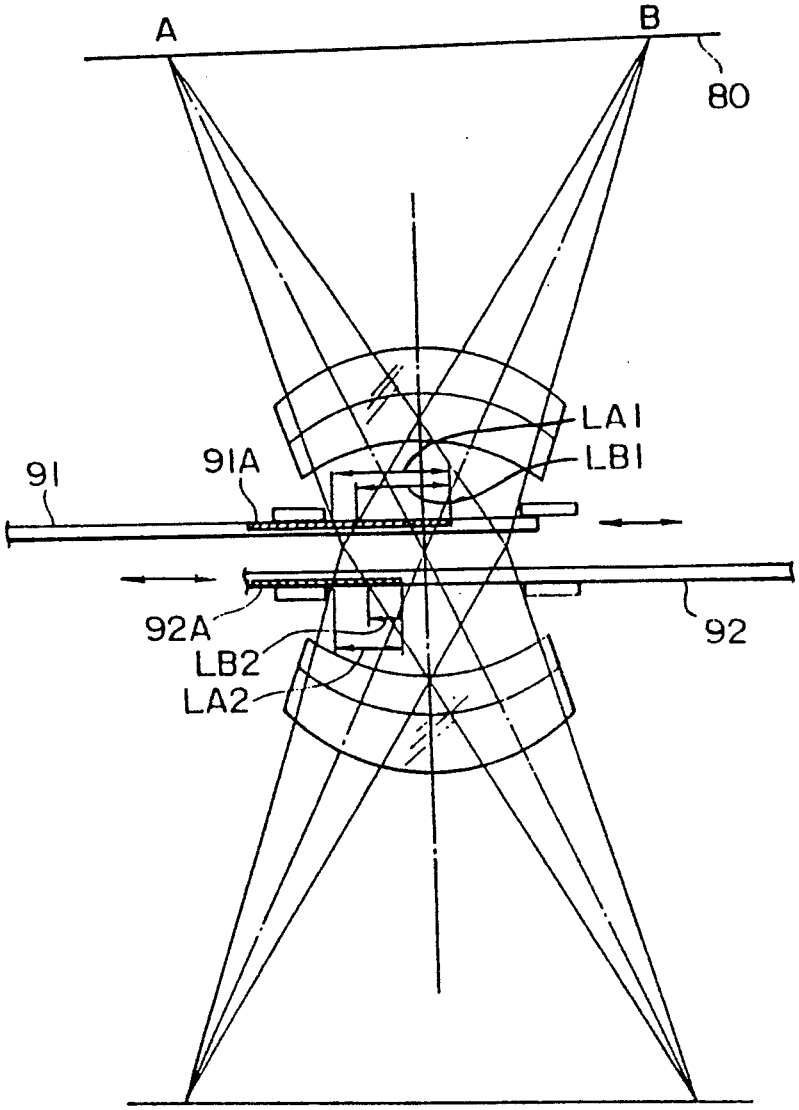
FIG. 1 (PRIOR ART)
FIG. 1 is a view showing a focusing optical system explaining a conventional problem.

The full-speed unit 21 is composed of a light source 21A and mirror 21B. The light source 21A irradiates a document 1 placed on the upper surface of the document table 10 with the document surface thereof facing downward (on the document table 10 side). The mirror 21B horizontally reflects a light reflected from the irradiated portion of the document 1 (the image light of the document 1) to the half-speed unit 22 located on the left side of the full-speed unit 21 in FIG. 1.

The half-speed unit 22 is composed of two mirrors, a mirror 22A and mirror 22B each having a reflecting surface. These reflecting surfaces intersect to each other at right angles, when extended. Further, the half-speed unit 22 is disposed with the open side thereof directed to the full-speed unit 21. The half-speed unit 22 reflects and reverses in parallel the image lights of the document 1 from the full-speed unit 21 and supplies the same to focusing lens 31 of the focusing optical system 30 to be described later.

As described above, the half-speed unit 22 is moved at one half the speed of the full-speed unit 21 in synchronism with the movement thereof in the same direction as the full-speed unit 21. With this arrangement, the length of the light path extending from the portion (document scanning portion) of the document 1 irradiated by the light source 21A of the full-speed unit 21 to the focusing lens 31 is fixed.

The focusing optical system 30 is composed of the focusing lens 31, a movable mirror unit 32 and a mirror 33. The focusing lens 31 is disposed at the position to which the image light of the document 1 is supplied from the half-speed unit 22; the movable mirror unit 32 is moved in synchronism with the change of the focusing distance of the focusing lens 31, and the mirror 33 reflects and bends the image light from the movable mirror unit 32 to the exposure/processing unit 40 to be described later.

The focusing lens 31 is a so-called zoom lens having a variable focusing distance.

The movable mirror unit 32 is composed of two mirrors 32A and 32B disposed in such a manner that the reflection surfaces of the two mirrors 32A and 32B intersect each other at right angles. The movable mirror unit 32 is disposed with the open side thereof directed to the mirror 33. The movable mirror unit 32 reverses and reflects the image lights of a document 1 from the focusing lens 31 to the mirror 33 in a parallel state. Further, the movable mirror unit 32 can be moved in the optical axis direction of the focusing lens 31 in synchronism with the change of the focusing distance of the focusing lens 31 so that a position focused by the focusing lens 31 coincides with a position exposed by the exposure/-processing mechanism 40.

Although not shown in detail, the exposure/processing mechanism 40 is composed of the feed mechanism 41 for feeding a photoconductive material and a processing mechanism 42 for developing and fixing the photoconductive material 2 fed by the feed mechanism 41.

The photoconductive material 2 is composed of a base paper and a color photoconductive agent layer formed thereon. When an image is formed on the photoconductive material 2, the feed mechanism 41 feeds the photoconductive material 2 in synchronism with the scanning movement (i.e., the scanning of the document 1 carried out by the scanning mechanism 20) of the full speed unit 21 of the aforesaid scanning mechanism 20. With this arrangement, the surface (i.e., the color photoconductive agent layer) of the photoconductive material 2 is exposed by the image light of the document 1.

The processing mechanism 42 develops and fixes the photoconductive material 2 having been exposed and being fed by the feed mechanism 41.

The copy machine arranged as described above will operate as described below.

The scanning mechanism 20 scans the document 1 placed on the upper surface of the document table 10 with the document surface thereof facing downward (on the document table 10 side). At this time, the scanning mechanism 20 irradiates the document 1 by the light source 21A of the full-speed unit 21 and moves in parallel with the document table 10 at a predetermined speed. The half-speed unit 22 moves at one half the speed of the full-speed unit 21 in synchronism with the scanning movement, of the full-speed unit 21. The image light of the document 1 irradiated by the light source 21A is reflected by the mirror 21B of the full-speed unit 21 and then incident on the focusing lens 31 of the focusing optical system 30 by being reflected by the mirrors 22A and 22B of the half-speed unit 22.

The focusing optical system 30 converges the image light of the document 1 supplied from the half-speed unit 22 through the focusing lens 31 and reflects the same through the movable mirror unit 32 and mirror 33. As a result, the image light is bent to intersect the photoconductive material 2 fed by the feed mechanism 41 at right angles. With this arrangement, the image of the document 1 is focused on the upper surface of the photoconductive material 2.

As described above, the photoconductive material 2 is fed by the feed mechanism 41 in synchronism with the scanning movement of the full speed unit 21. As a result, the photoconductive material 2 is exposed by the image lights from the entire region of the document 1.

The processing mechanism 42 develops and fixes the photoconductive material 2 having been exposed. The photoconductive material 2 having been developed and fixed is fed by the feed mechanism 41 and discharged to the outside of the imaging device.

A filter unit 50, as one embodiment of a color correction structure according to the present invention, is interposed between the movable mirror unit 32 and the mirror 33.

The filter unit 50 includes three filters in this embodiment, i.e., an Y filter 51Y, a M filter 51M and a C filter 51C disposed perpendicularly to the light path 3 from the movable mirror unit 32 to the mirror 33. The filters 51Y, 51M and 51C are disposed perpendicularly to the light path 3 at positions where they do not interfere with the light path and at positions where they are interposed in the light path 3. As a result, the filters 51Y, 51M and 51C can enter the light path 3 and exit therefrom.

Figure 3:
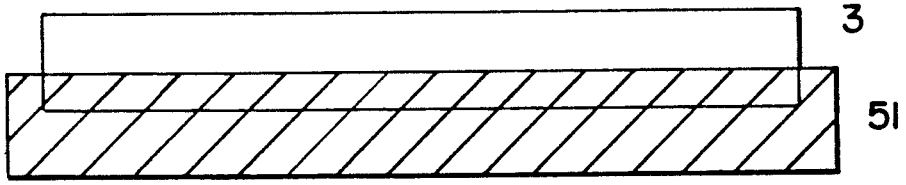
FIG. 3 is a view showing a direction in which a filter enters a light path and exits therefrom.

As shown in FIG. 3, the filters 51 (51Y, 51M and 51C). enter the light path 3 and exit therefrom in a direction in which the light image of a document intersects the width direction thereof at right angles.

Figure 4:
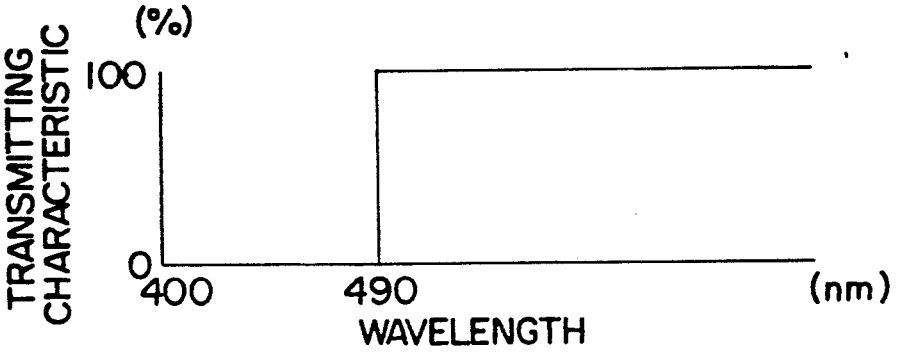
FIG. 4 is a diagram showing a wavelength transmitting characteristics of a yellow filter.
Figure 5:
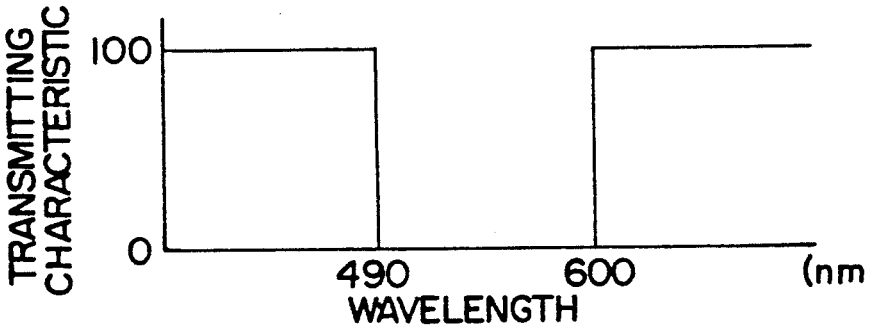
FIG. 5 is a diagram showing a wavelength transmitting characteristics of a magenta filter.
Figure 6:
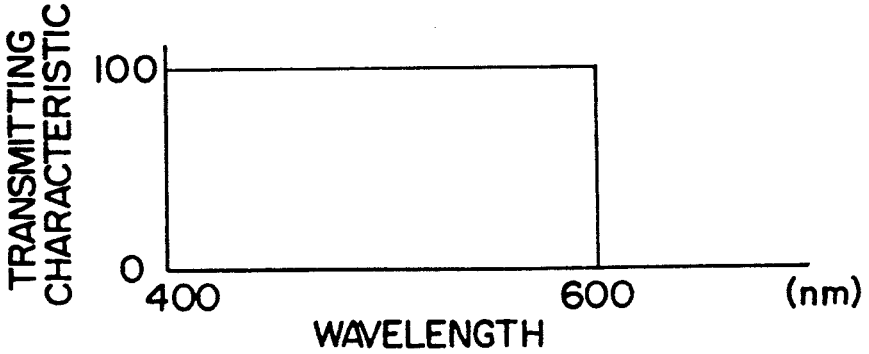
FIG. 6 is a diagram showing a wavelength transmitting characteristics of a cyan filter.

The three filters 51Y, 51M and 51C have wavelength transmitting characteristics shown in FIGS. 4 to 6, respectively. More specifically, the Y filter 51Y does not transmit light having a wavelength shorter than 490 nm, as shown in FIG. 4; the M filter 51M does not transmit light having a wavelength from 490 nm to 600 nm and transmits a light having a wavelength longer than 600 nm and shorter and shorter than 490 nm, as shown in FIG. 5; and the C filter 51C does not transmit light having a wavelength longer than 600 nm, as shown in FIG. 6. Note, in FIGS. 4–6, the horizontal axis represents a wavelength and the vertical axis represents an amount of a transmitted light.

It should be noted that the overlapping area of these three filters 51Y, 51M and 51C in the optical axial direction, which interferes with the light path 3, functions as a variable diaphragm. That is, the overlapping area of the three filters 51Y, 51M and 51C never transmit a light having all wavelengths, thereby presenting the light from transmitting therethrough. The degree of the prevention of the light transmitting is set to be according to the protrusion length (or interfering area) of the overlapping area of the three filters 51Y, 51M and 51C into the light path 3.

The three filters 51Y, 51M and 51C are moved by actuators 52Y, 52M and 52C, respectively, and can independently interfere with the light path 3, respectively. The filters 51Y, 51M and 51C are not moved stepwise but moved continuously by actuators 52Y, 52M and 52C so that an area of the light path 3 occupied by the filters 51Y, 51M and 51C (a ratio of the area occupied by the filters 51 to the entire area of the light path 3) can be arbitrarily set.

The actuators 52Y, 52M and 52C are independently controlled by a controller 60, to which an operation panel 62 disposed on the upper surface of the main body 11 of the color copying machine is connected. The operation panel 62 is arranged adjacent to the document table 10. Furthermore, the operation panel 62 includes a hue adjusting button 62*a* and a brightness adjusting button 62*b*. The controller 60 controls the actuators 52Y, 52M and 52C based on the setting condition in the operation panel 62 by an operator.

When an image is formed, the filter unit 50, arranged as described above, will operate as follows:

Color can be corrected by causing the three filters 51Y, 51M and 51C to interfere with the light path 3 independently or in combination. An amount of correction can be adjusted by adjusting an amount of interference of each filter 51 with the light path 3.

Further, when the three filters 51Y, 51M and 51C interferes with the light path 3 in an even overlapped state, an amount of light can be adjusted in the region of the entire wavelengths functioning as a variable diaphragm. That is, the correction of color and the adjustment of an amount of light can be simultaneously carried out by controlling the combination of amounts of overlap of the three filters 51Y, 51M and 51C and an amount of interference of the filters with the light path 3.

Figure 7:
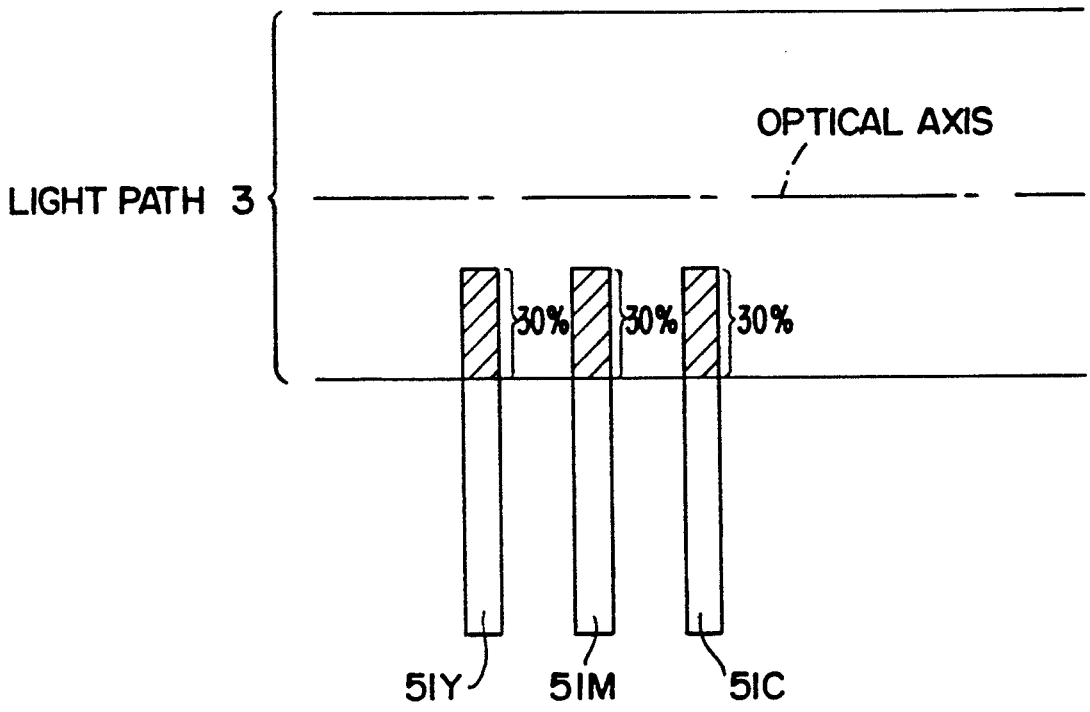
FIG. 7 is a diagram showing one aspect of the filter movement.

More specifically, as shown in FIG. 7, when the operator operates the brightness adjusting button 62*b*, the controller 60 controls the actuators 52Y, 52M and 52C to move all the filters 51Y, 51M and 51C to interfere with the light path 3 by an even amount of interference, such as, for example, 30%, with respect to the area of cross-section of the light path 3, so that the amount of light has been adjusted to be decreased by 30% but the amount of correction has been set to be zero. In other words, the color has not been changed or absorbed.

Figure 8:
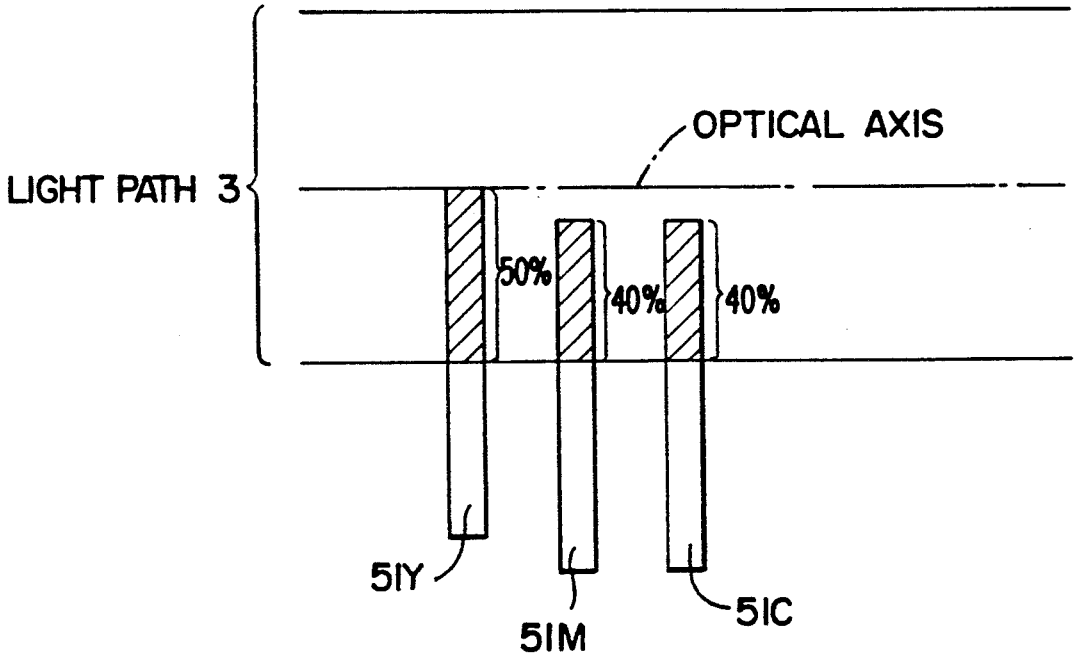
FIG. 8 is a diagram showing another aspect of the filter movement.

On the other hand, as shown in FIG. 8, when the operator operates the hue adjusting button 62*a* and the brightness adjusting button 62*b*, the controller 60 controls actuator 52Y to move the corresponding filter 51Y to interfere with the light path 3 by an amount of interference of, for example, 50%, and actuators 52M and 52C to move the corresponding filters 51M and 51C to interfere with the light path 3 by an even amount of interference, for example, 40%, so that the amount of light has been adjusted to be decreased by 40% and the amount of color correction has been set to be absorbed by 10% of blue light.

When the operator operates the hue adjusting button 62*a* only, the controller 60 controls one of three actuators 52M, 52Y and 52C or two of the three actuators 52M, 52Y and 52C to move the corresponding filters 51M, 51Y and 51C to interfere with the light path 3 by predetermined amounts set on the operation panel 62, although not shown, so that the amount of color correction is set.

According to the above arrangement, filters 51Y, 51M and 51C enter the light path 3 and exit therefrom in the direction in which the image light of the document intersects the width direction thereof at right angles), as described above. As a result, even if a different angle is formed between an incident light and the light axis because the incident light is supplied from a different point in the width direction of the document, an amount of interference of the filters 51Y, 51M and 51C with the light path 3 is not different. Thus, an irregular color is not caused.

Further, since the filters 51Y, 51M and 51C are not disposed in the light path of the focusing lens 31 and do not optically influence the focusing lens, they need not have flatness and the like of a pinpoint accuracy, and thus, they may be formed of plastics to reduce the cost thereof.

Further, since a variable diaphragm need not be disposed in the focusing lens, the size of the focusing lens can be reduced.

It would be clear that the present invention is not limited to the embodiment described above, nor those illustrated in the drawings, and the invention can be modified without departing from the spirit and scope of the claimed invention.

Figure 9:
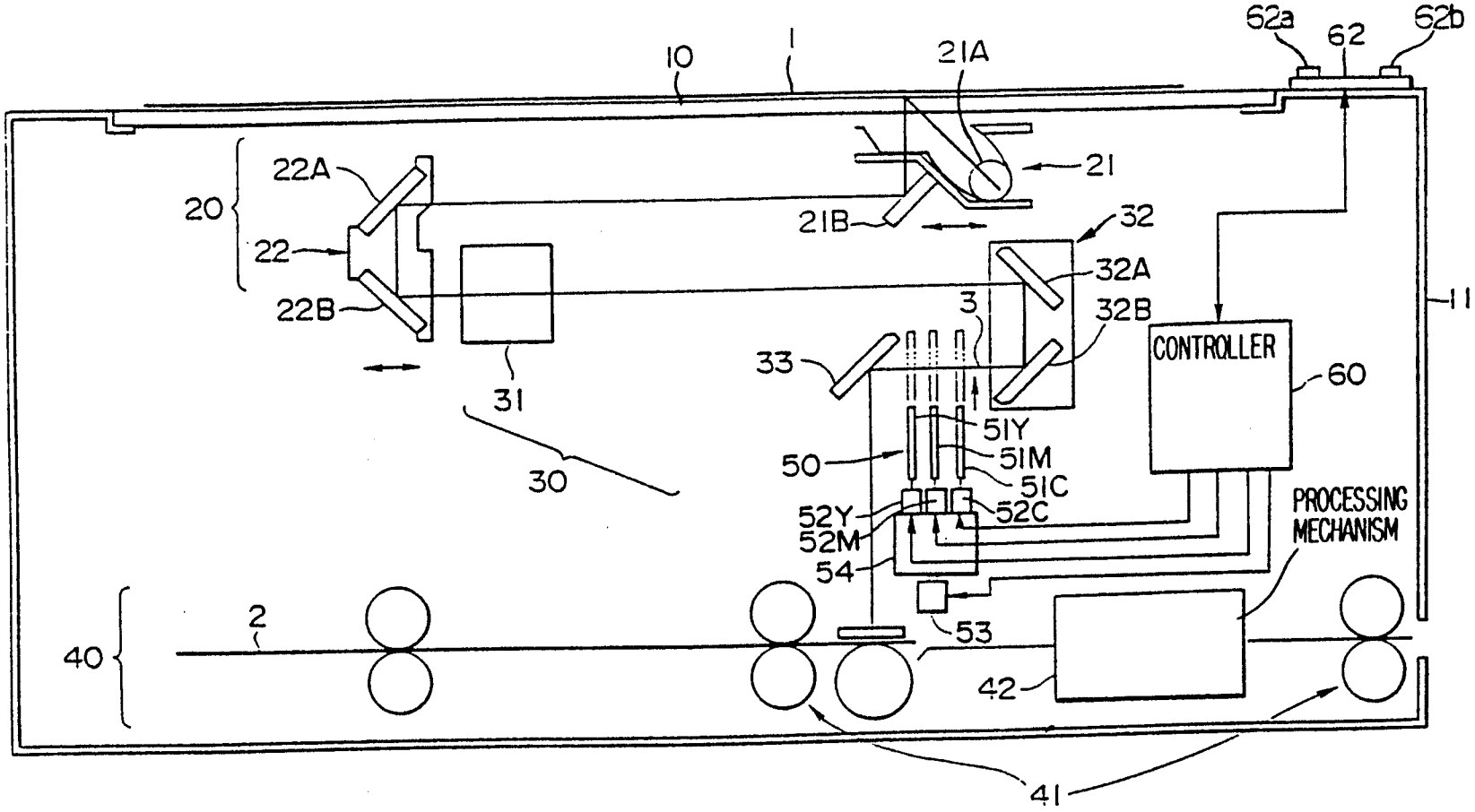
FIG. 9 is a side view showing a schematic arrangement of a slit scanning type color copy machine to which a second embodiment according to the present invention is applied.

Though, the above embodiment is explained as the three filters 51Y, 51M and 51C are independently actuated by the corresponding actuators 52Y, 52M and 52C, it is possible to construct, as shown in FIG. 9, a second embodiment. It should be noted that the same numerals as used in the portions of the first embodiment are used to designate the corresponding portions of the following embodiments, and therefore, the description thereof will be omitted.

In the second embodiment, a main actuator 53 is provided for moving the three actuators 52Y, 52M and 52C as a whole. In other words, the main actuator 53 is provided for the brightness adjusting button 62*b*, while the three actuators 52M, 52Y and 52C are provided for the hue adjusting button 62*a*. More specifically, a moving block 54 is connected to the main actuator 53 and moved by the main actuator 53 in the same direction in which the filters 51Y, 51M and 51C are moved by the corresponding actuators 52Y, 52M and 52C. The actuators 52Y, 52M and 52C are disposed on the moving block 54.

With the construction of the second embodiment, the main actuator 53 is actuated when the brightness adjusting button 62*b* is operated. Accordingly, the adjustment of an amount of light can be carried out, while one or two of the actuators 52Y and/or 52M and/or 52C is actuated when the hue adjusting button 62*a* is operated. Accordingly the correction of color can be carried out. In other words, it is not necessary to actuate the three actuators 52Y, 52M and 52C when the adjustment of an amount of light or the brightness should only be carried out.

Next, a third embodiment according to the present invention, shown in FIG. 10 will be described.

Figure 10:
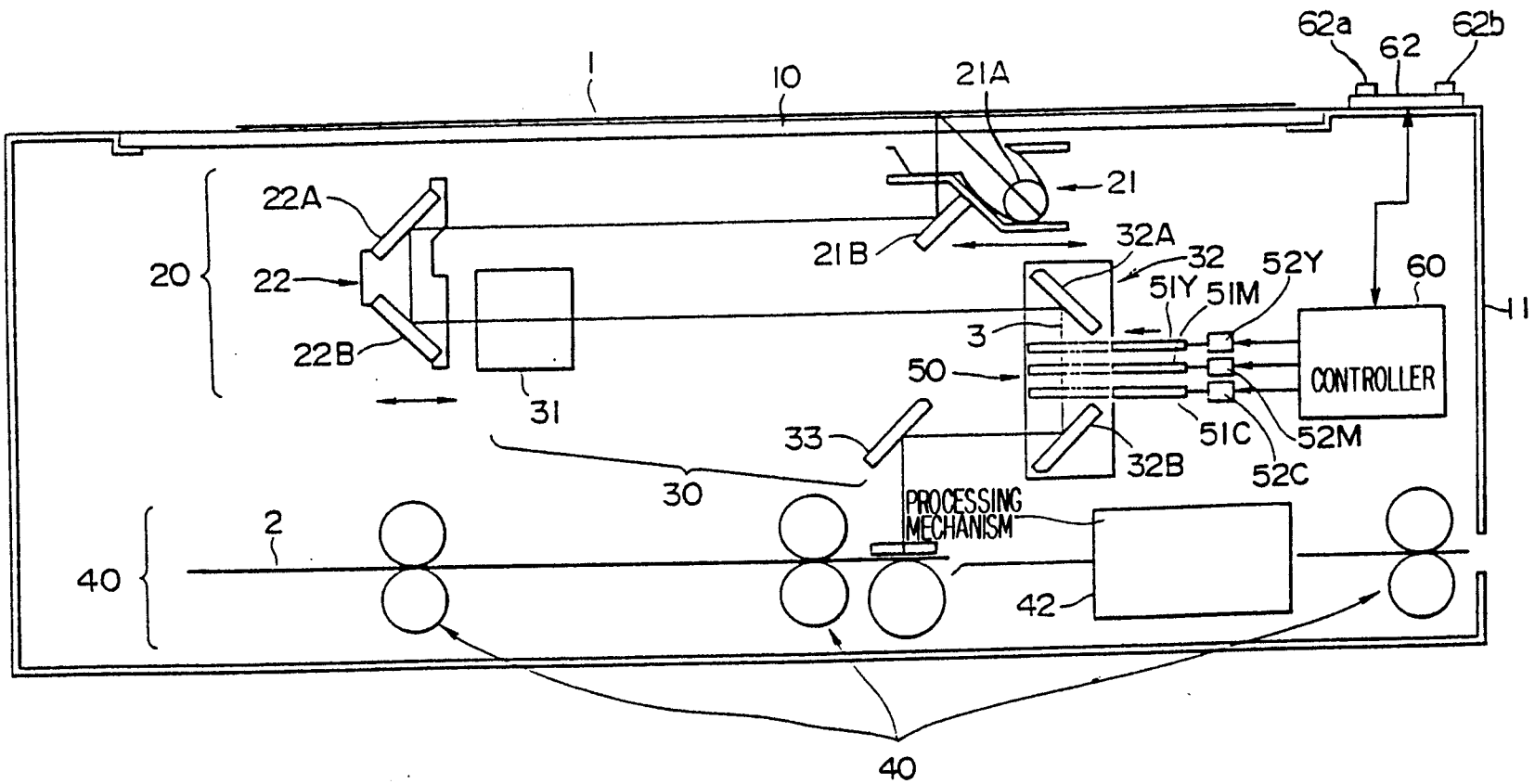
FIG. 10 is a side view showing a schematic arrangement of a slit scanning type color copy machine to which a third embodiment according to the present invention is applied.

The copy machine shown in FIG. 10 has the same arrangement as that of the aforesaid first embodiment shown in FIG. 2, except for the position of a filter unit 50.

According to the third embodiment, filter unit 50 is provided with a movable mirror unit 32 and filters 51Y, 51M and 51C are interposed between two mirrors, a mirror 32A and a mirror 32B. Since the filters 51Y, 51M and 51C are disposed in the vertical light path 3 from the mirror 32A to the mirror 32B, it can be horizontally moved. The arrangement and operation of the filter unit 50 is the same as that of the aforesaid embodiment.

According to the above arrangement of the third embodiment, since the filters 51Y, 51M and 51C of the filter unit 51 are moved in the direction parallel with a document table, the height of the copy machine can be lowered as a whole.

The present disclosure relates to a subject matters contained in Japanese Patent Application No. HEI 3-311271, filed on Sep. 17, 1992, which is expressly incorporated herein by reference in its entirety.

What is claimed is:

1. A color correction structure for a color imaging device, in which a document is scanned in a predetermined direction by a slit exposure light, a light reflected on said document being lead to a photoconductive member along an optical path, and an image of said document being focused on said photoconductive member by a focusing lens which is arranged in said optical path, comprising:

filter means for transmitting reflected light having a predetermined wavelength, said filter means including a plurality of filter members, each filter member having different wavelength transmitting characteristics;

means for independently actuating each of said filter members in a direction that is substantially perpendicular to an extending direction of said slit exposure light between a first position where each of said filter members is retracted from said light path and a second position where each of said filter members interferes with said light path; and means for controlling said actuating means in such a manner that said actuating means actuates all of said filter members by an equal amount of movement in a direction when a light brightness adjustment is to be performed, said controlling means actuating predetermined filter members comprising less than all of said plurality of filter members when a color of said light is to be corrected so as to have predetermined wavelength characteristics.

2. The color correction structure of claim 1, wherein said actuating means actuates said filter means to protrude into said light path with an adjustable interference amount with said light path.

3. The color correction structure of claim 1, wherein said focusing lens comprises a zoom lens having a variable focal length.

4. The color correction structure of claim 1, wherein said actuating means actuates at least one of said filter members to protrude into said light path with an adjustable interference amount with said light path.

5. The color correction structure of claim 3, wherein each of said filter members has a substantially equal amount of damping light over substantially an entire region of wavelengths being used.

6. The color correction structure of claim 1, wherein said photoconductive member comprises a base sheet and a color photoconductive agent layer that is formed thereon.

7. The color correction structure of claim 1, wherein said color imaging device comprises:

a contact glass on which said document is placed;

a slit light source for slit exposing said document that is placed on said contact glass;

a front group of mirrors that are disposed in front of said focusing lens with respect to a light transmitting direction from said document to said photoconductive member, for deflecting said image light from said document to said focusing lens; and a rear mirror that is disposed in back of said focusing lens with respect to said light transmitting direction, for deflecting said image light from said focusing lens to said photoconductive member.

8. The color correction structure of claim 7, wherein said filter means is disposed between said rear mirror and said photoconductive member.

9. The color correction structure of claim 7, wherein said color imaging device further comprises a final fixed mirror that is disposed between said rear mirror and said photoconductive member.

10. The color correction structure of claim 9, wherein said filter means is disposed between said rear mirror and said final fixed mirror.

11. The color correction structure of claim 7, wherein said color imaging device further comprises:

a full-speed unit having said light source and a mirror for deflecting said image light of said document to said front group of mirrors in a direction that is parallel with said document for carrying out a scanning movement in parallel with said document; and a half-speed unit that moves at half the speed of said full-speed unit in synchronism with a scanning movement of said full-speed unit in a same direction as said full-speed unit, said half speed unit extending said front group of mirrors that include two mirrors which are confronting at right angles and has an open side thereof directed to said full-speed unit, said half-speed unit deflecting said image light from said full-speed unit by said two mirrors so that said image light is introduced to said focusing lens with a direction thereof reversed, and said photoconductive member is moved in synchronism with said scanning movement of said full-speed unit.

12. The color correction structure of claim 7, wherein said filter member protrudes into said light path and retracts therefrom in a direction perpendicular to a scanning direction of a full-speed unit.

13. The color correction structure of claim 1, wherein said color imaging device comprises:

a contact glass on which said document is placed;

a slit light source for slit exposing said document that is placed on said contact glass;

a front group of mirrors that are disposed in front of said focusing lens with respect to a light transmitting direction from said document to said photoconductive member, for deflecting said image light from said document to said focusing lens; and a rear group of mirrors that are disposed in back of said focusing lens with respect to said light transmitting direction, for deflecting said image light from said focusing lens to said photoconductive member.

14. The color correction structure of claim 13, wherein said filter means is disposed between mirrors comprising said rear group of mirrors.

15. The color correction structure of claim 13, wherein said color imaging device further comprises:

a full-speed unit having said light source and a mirror for deflecting said image light of said document to said front group of mirrors in a direction that is parallel with said document for carrying out a scanning movement in parallel with said document; and a half-speed unit that moves at half the speed of said full-speed unit in synchronism with a scanning movement of said full-speed unit in a same direction as said full-speed unit, said half speed unit extending said front group of mirrors that include two mirrors which are confronting at right angles and has an open side thereof directed to said full-speed unit, said half-speed unit deflecting said image light from said full-speed unit by said two mirrors so that said image light is introduced to said focusing lens with a direction thereof reversed, and said photoconductive member is moved in synchronism with said scanning movement of said full-speed unit.

16. The color correction structure of claim 13, wherein said filter member protrudes into said light path and retracts therefrom in a direction parallel with a scanning direction of a full-speed unit.

17. The color correction structure of claim 3, wherein said filter means comprises a yellow filter, a magenta filter, and a cyan filter.

18. The color correction structure of claim 4, wherein said actuating means comprises a plurality of actuators corresponding to said plurality of filter members.

19. The color correction structure of claim 18, wherein said actuating means further comprises:

a moving block on which said plurality of actuators are disposed; and a main actuator for moving said moving block.

20. The color correction structure of claim 19, wherein said main actuator moves said moving block in a direction parallel with said moving direction of said filter means.

21. An apparatus for correcting a color of a document scanned in a color imaging device, comprising:

a plurality of filters having different wavelength transmitting characteristics;

a plurality of actuators, each one of said plurality of actuators is associated with a respective one of said plurality of filters, said plurality of actuators being independently operable to move said plurality of filters between a first position where each one of said plurality of filters are retracted from an exposure light and a second position where said plurality of filters interfere with said exposure light; and a controller that controls said plurality of actuators to equally drive all of said plurality of filters in a direction to adjust a light brightness, and to drive fewer than all of said plurality of filters to perform a color correction.

22. The color correcting apparatus of claim 21, wherein said plurality of filters are disposed between a rear mirror and a photoconductive member of said color imaging device.

23. The color correcting apparatus of claim 21, wherein said plurality of filters are disposed between a rear mirror and a final fixed mirror of said color imaging device.

24. The color correcting apparatus of claim 21, wherein said plurality of filters are disposed between mirrors that form a rear group of mirrors of said color imaging device.

25. The color correcting apparatus of claim 21, further comprising a moving block on which said plurality of actuators are disposed, and a main actuator for shifting said moving block.

26. A color correction structure for a color imaging device, in which a document is scanned in a predetermined direction by a slit exposure light, a light reflected on said document being lead to a photoconducive member along an optical path, and an image of said document being focused on said photoconductive member by a focusing lens which is arranged in said optical path, comprising:

filter means for transmitting reflected light having a predetermined wavelength, said filter means including a plurality of filter members, each filter member having different wavelength transmitting characteristics;

means for independently actuating each of said filter members in a direction that is substantially perpendicular to an extending direction of said slit exposure light between a first position where each of said filter members is retracted from said light path and a second position where each of said filter members interfere with said light path; and means for controlling said actuating means in such a manner that said actuating means actuates all of said filter members by an equal amount of movement in a direction when a light brightness adjustment is to be performed.

* * * * *

UNITED STATES PATENT AND TRADEMARK OFFICE

CERTIFICATE OF CORRECTION

PATENT NO. : 5,321,487

DATED : June 14, 1994

INVENTOR(S) : Sukenori SHIBA et al.

It is certified that error appears in the above-indentified patent and that said Letters Patent is hereby corrected as shown below:

On the cover page, item [57], "ABSTRACT", lines 8-9, change "a plurality of filter members each transmitting" to ---at least one filter member for transmitting the---.

On the cover page, item [57], "ABSTRACT", line 10, after "wavelength," insert ---arranged in the optical path with the focusing lens,---.

On the cover page, item [57], "ABSTRACT", lines 16-17, delete "A controller controls the actuator for brightness and hue adjustments.".

Signed and Sealed this

Nineteenth Day of September, 1995

*Attest:*

*Attesting Officer*

Bruce Lehman

BRUCE LEHMAN

*Commissioner of Patents and Trademarks*